United States Patent [19]

Attwell

[11] 4,090,827

[45] May 23, 1978

[54] APPARATUS FOR MOULDING AND EXTRUSION

[75] Inventor: Ronald Leslie Attwell, Dorchester on Thames, England

[73] Assignee: London Brick Buildings Limited, England

[21] Appl. No.: 609,498

[22] Filed: Sep. 2, 1975

[51] Int. Cl.[2] ..... B28B 1/08

[52] U.S. Cl. ..... 425/64; 425/130; 425/219; 425/376 B; 425/456; 425/308

[58] Field of Search ..... 425/130, 223, 224, 308, 425/456, 63, 64, 376, 219, 432, 130.1

[56] References Cited

U.S. PATENT DOCUMENTS

| | | | |
|---|---|---|---|
| 1,353,512 | 9/1920 | Baumgarte | 425/130 X |
| 1,613,631 | 1/1927 | Weiss | 425/456 X |
| 2,101,031 | 12/1937 | Little | 425/456 X |
| 3,098,415 | 7/1963 | Guntert et al. | 425/456 X |
| 3,217,375 | 11/1965 | Kinnard | 425/130 |
| 3,427,372 | 2/1969 | Berner | 425/130 X |
| 3,926,541 | 12/1975 | Hewitt | 425/456 X |

*Primary Examiner*—Robert L. Spicer, Jr.
*Attorney, Agent, or Firm*—Gifford, Chandler, Van Ophem, Sheridan & Sprinkle

[57] ABSTRACT

A method and apparatus for fluidizing crushed, pulverized, comminuted powdered or other particulate solids, with or without added liquid, that will not flow readily under gravity, to enable this material to flow through an aperture either as an extrusion or to cause it to conform precisely to the shape of a mold, including inserting the material into the top of a hopper having an aperture at its base through which the material is discharged under gravity to a surface or into a mold, subjecting the material while in the hopper to one or more vibrators arranged to effect vibration of said material in the intended direction of flow through the hopper to cause the material to flow freely through the hopper, and effecting relative movement between the hopper and the surface or mold to effect the withdrawal of the material discharged from the hopper.

12 Claims, 19 Drawing Figures

APPARATUS FOR MOULDING AND EXTRUSION

BACKGROUND OF THE INVENTION

I. Field of the Invention

This invention relates to a method and an apparatus for fluidizing crushed, pulverized, comminuted, powdered or other particulate solids, with or without some added liquid, in a hopper, to enable this material to be extruded through a restrictive aperture or to cause it to conform precisely to the shape of a mold. Thus, the invention relates to such materials in conditions in which, in the absence of fluidizing they cannot flow or can only flow sluggishly under gravity. The invention is primarily concerned with rendering cement, gypsum or plaster mixes sufficiently fluid to be formed by extrusion or molding into predetermined shapes which due to compaction and normal chemical action harden or set sufficiently rapidly for practical purposes without the necessity for adopting additional chemical means, heat treatment or the application of high pressure to the extruded or molded material. The said cement, gypsum or plaster mixes may have granular or fibrous additives such as sand, gravel or crushed rock aggregates, glass, asbestos, particles of steel, polypropylene or other synthetic or natural fibers, also ground rubber and cork. The invention is also applicable to the extrusion in the form of slabs or ribbons of road making materials such as concrete and aggregate mixes or bitumenbound aggregate or asphalt, or plain aggregates or natural soils.

II. Description of the Prior Art

Heretofore compaction of concrete has been effected after the material has been placed in a mold or positioned where it is permanently required. Thus, pressure compaction requires a wet mix which makes relatively weak concrete unless excess water is removed by additional pressure or by a vacuum-suction method. Pressure systems may only be used on static equipment. With road making machines where compaction is effected after the concrete has been laid by the use of vibrators inserted into the concrete, segregation and irregular compaction is a common fault. Compaction by the use of extrusion processes which work by screw or hydraulic pressure cause stress in the material causing it to bow or curve. Normally work is limited to extrusions having fairly large cross-sectional areas, say of 10 cms. by 12.5 cms.

SUMMARY OF THE INVENTION

An object of the present invention is to provide means whereby the aforesaid disadvantages of other compaction processes are not required and, in particular, to provide a concrete extruding and molding machine which will enable cement, gypsum or plaster mix materials to be extruded by a process of fluidizing the material and allowing it to be compacted and molded without the use of additional sources of vibration.

The present invention provides a method of fluidizing crushed, pulverized, comminuted, powdered or other particulate solids, with or without added liquid, that will not flow readily under gravity, to enable this material to flow through an aperture either as an extrusion or to cause it to conform precisely to the shape of a mold, including inserting the material into the top of a hopper having an aperture at its base through which the material is discharged to a surface or into a mold, subjecting the material while in the hopper to one or more vibrators arranged to effect vibration of said material in the intended direction of flow through the hopper to cause said material to flow freely through the hopper, and effecting relative movement between the hopper and said surface or mold to effect the withdrawal of the material discharged from the hopper.

According to the invention, apparatus for effecting this method includes a hopper open at the top to receive the said material and having an outlet aperture in its lower end, a mechanical vibrator having a rotatable shaft carrying an eccentric weight, the vibrator extending transversely of the hopper above or below said outlet aperture, means for rotating the vibrator shaft to effect vibration of material in the hopper in the intended direction of flow through the hopper and means for bringing about relative movement between the hopper and a surface or mold to which the material is delivered after leaving the hopper.

BRIEF DESCRIPTION OF THE DRAWINGS

In order that the invention may be clearly understood and readily carried into effect several forms of apparatus and methods in accordance therewith will now be described by way of example, with reference to the accompanying drawings, in which.

BRIEF DESCRIPTION OF THE PREFERRED EMBODIMENT

Figure 1:
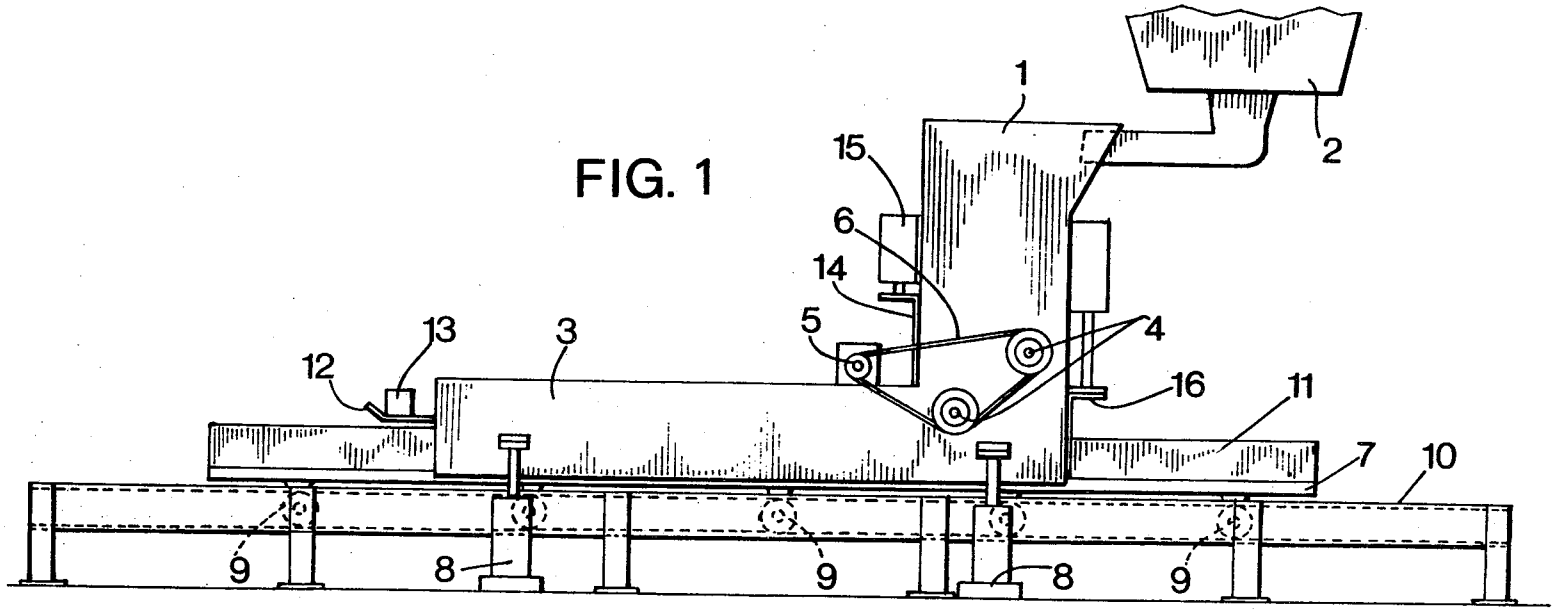
FIG. 1 is a side elevation of an extruding and molding machine.
Figure 2:
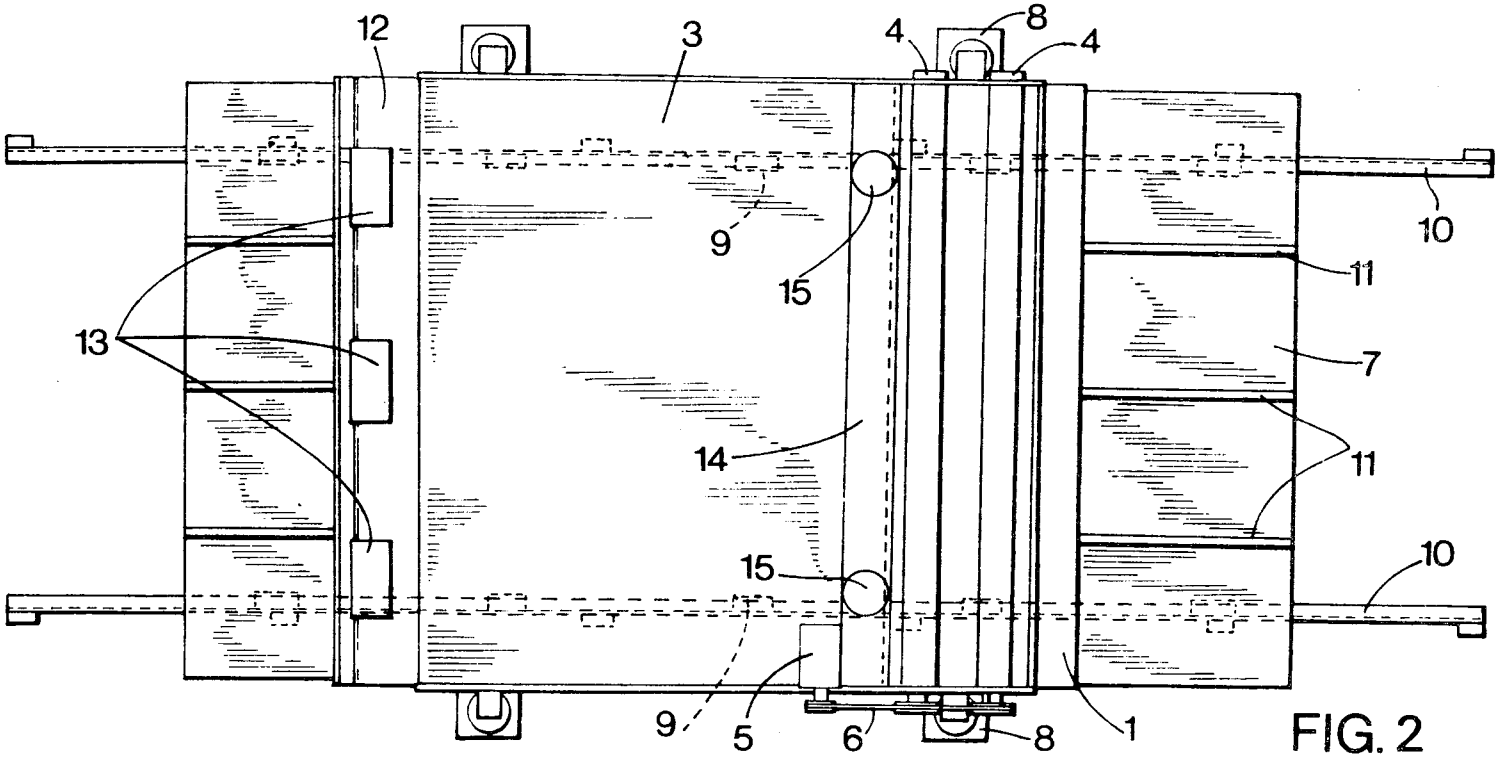
FIG. 2 is a plan of the machine of FIG. 1.

Referring to FIGS. 1 and 2, the machine comprises a hopper 1 supplied with material to be extruded from a mixer or silo 2 (omitted from FIG. 2). The hopper 1 leads to an extrusion chamber 3. At appropriate points in the hopper are mounted tubular vibrators 4, described in greater detail below hereinafter with reference to FIGS. 15-17. These vibrators are of variable frequency and are preset as to amplitude. They are driven by a motor engine, or other power source 5, for example by belt drive 6. The extrusion chamber 3 is an open ended box having top and side walls with a fitted base 7 relatively to which the box may be raised or lowered by jacks 8, such as hydraulic jacks, which raise and lower the entire machine. The base 7 is mounted on wheels 9 which run in rails 10 along which the base 7 is driven by a drive unit (not shown).

In operation, a concrete mix, or similar material is loaded into the hopper 1 from the mixer or silo 2, the vibrators 4 are activated to effect vibration of the material in the intended direction of flow through the hopper to the base 7 and the base 7 is caused to travel through the chamber 3. As the material in the hopper 1 is vibrated it flows and compacts into the extrusion chamber 3 and is carried on the base 7 through the machine. The same procedure may be used to fill molds or shuttering placed on the base 7.

When forming a slab or block in the extrusion chamber, the thickness of the slab or block may be adjusted by the jacks 8. Different widths of the finished product may be produced within the whole width of the extrusion chamber by mounting separator leaves 11 on the base 7.

A top extension 12 may be fitted to the extrusion chamber and vibrated upwardly and downwardly by vibrators 13 so as to provide an extra control over the surface finish of the product. A cut off or guillotine blade 14 movable by actuators 15 is mounted at the mouth of the extrusion chamber for cutting off predetermined lengths of the extruded product. Lengths of reinforcement may be introduced through the rear of the hopper beneath a plate 16.

Figure 3:
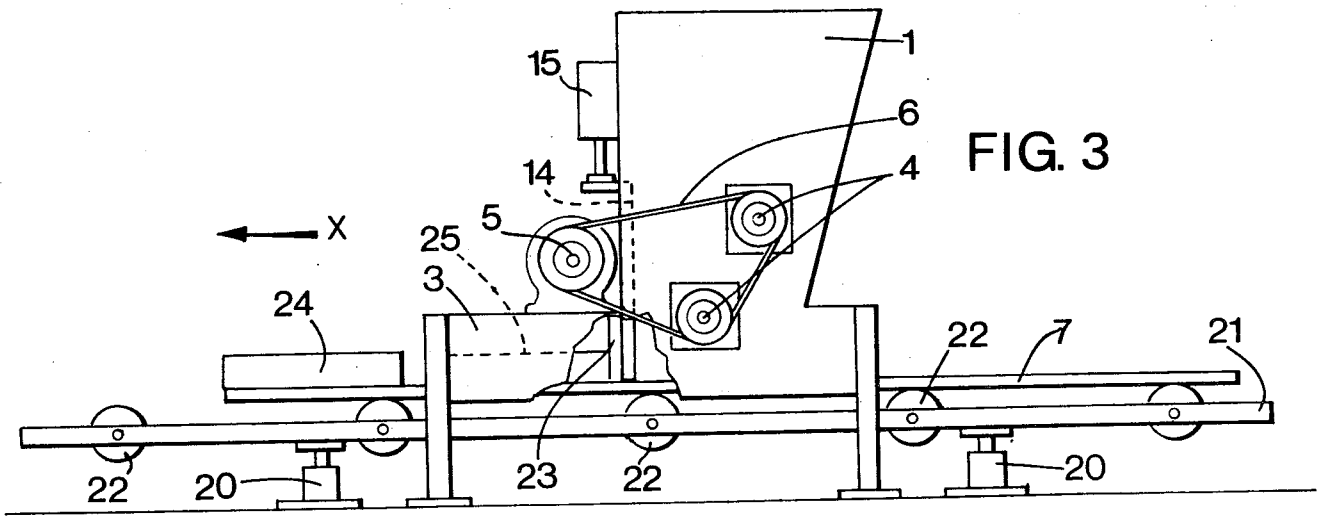
FIG. 3 is a side elevation of a modification of the machine of FIGS. 1 and 2; shown with a portion of a side wall of the machine broken away.

The modification of FIG. 3 is similar to that of FIGS. 1 and 2. Like parts are indicated by the same reference numbers and include a hopper 1 in which vibrators 4 are mounted so that they extend across the width of the machine. The machine also includes an extrusion chamber 3 into which the material flows from the hopper. However, the machine itself is not mounted on jacks. Instead jacks 20 support a roller bed 21 on the rollers 22 of which the base 7 of the extrusion chamber 3 runs. An upright extrusion plate 23 is mounted within and transversely of the extrusion chamber 3. The jacks 20 are adjusted so that the base 7 runs with the required clearance beneath the extrusion plate 23. Alternatively where molds, of which one is shown at 24, are to be filled, the extrusion plate 23 is removed and the molds 24 are mounted on the base 7, which is adjusted for height by means of the jacks 20 to enable the molds 24 to pass through the extrusion chamber 3 with a minimum of clearance between the top of the molds 24 and the underside of a top plate 25 of the extrusion chamber 3. Cut off of material, when so desired, is effected by a guillotine blade 14 operated by an actuator 15, as in FIGS. 1 and 2.

In use, cement, gypsum or plaster mix is placed in the hopper 1 and the vibrators, which are driven by the motor 5, are activated. At the same time the base 7 is caused, either manually or by a driving motor (not shown), to move forward in the direction of the arrow X. The vibration fluidizes the mix which flows past the extrusion plate 23 and into the base 7 or into the mold 24 and is taken away on the moving base 7.

Figure 4:
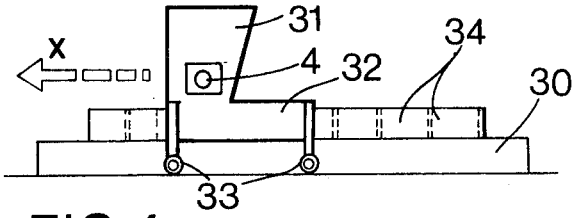
FIGS. 4, 5 and 6 are diagrammatic side elevations of three further modifications.

FIG. 4 shows diagrammatically a modification of the machine of FIG. 3, in which a base 30 is stationary and the machine comprising a hopper 31 and an extrusion chamber 32 is mounted on wheels 33 and is arranged to travel in the direction of arrow X while filling molds 34, or extruding one or more slabs on the fixed mold carrier or base 30. The hopper includes one or more vibrators such as 4 in FIGS. 1 and 2.

Figure 5:
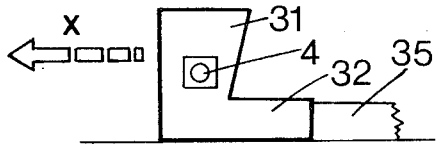

FIG. 5 shows a principle of operation similar to that performed by the machines of FIG. 4 but arranged for the moving machine 31, 32 to compact and lay a continuous slab or ribbon of material 35 directly onto ground 36 on which the machine is permanently retained. The arrangement of FIG. 5 may be applied to slabs of various thicknesses and to conventional road making materials such as concrete and aggregate mixes or bitumen-bound aggregate or asphalt. It is also applicable to plain aggregate or natural soils which may be coated, after being placed in position, with bitumen or another sealer.

Figure 6:
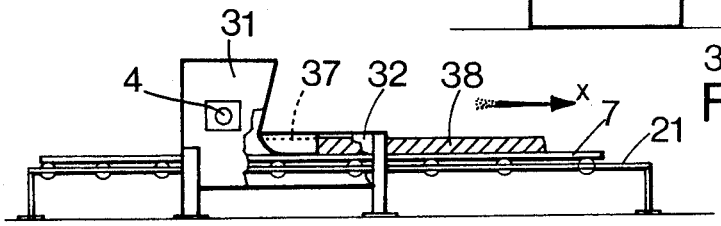

FIG. 6 shows an arrangement similar to that of FIG. 3, and applicable to that of FIG. 4, in which an extrusion die 37 is mounted in the extrusion chamber 32. The mold is transversely shaped according to a required configuration, whereby material 38 extruded from the hopper 31 onto a base such as 7 or a mold such as 24 in FIG. 3 and formed on its top and side faces at all cross-sections along its length with this configuration. The roller bed 21 of rollers 22 are shown as in FIG. 3.

Figure 7:
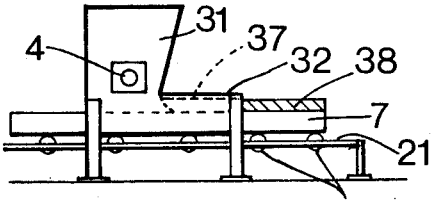
FIGS. 7 and 8 are respectively diagrammatic side and end elevations of yet another modification.
Figure 8:
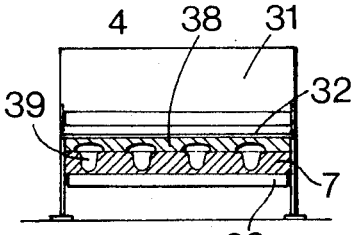

FIGS. 7 and 8 show a modification of the arrangement of FIG. 6 in which the extruded material 38 is shaped on its under surface by a molded formation 39 on the base 7 and on its upper surface by an extrusion die 37 fixed inside the extrusion chamber 32.

Figure 9:
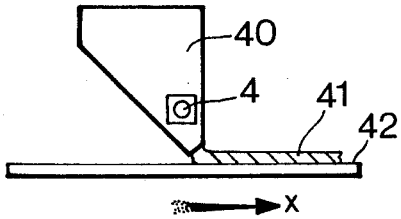
FIGS. 9, 10 and 11 are diagrammatic side elevations of three more modifications.

In the machine of FIG. 9, no extrusion chamber is provided and a hopper 40 discharges a continuous ribbon 41 of material to coat or cover a surface 42 travelling in the direction of the arrow X. The surface 42 may be the upper surface of a moving belt or platform.

Figure 10:
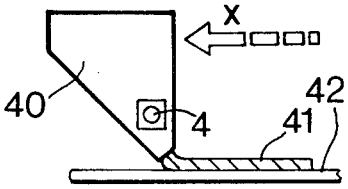

FIG. 10 shows an arrangement which is the same as that of FIG. 9 except that the machine, illustrated by the hopper 40, travels in the direction of the arrow X and the ribbon 41 of material in laid on a stationary surface 42.

Figure 11:
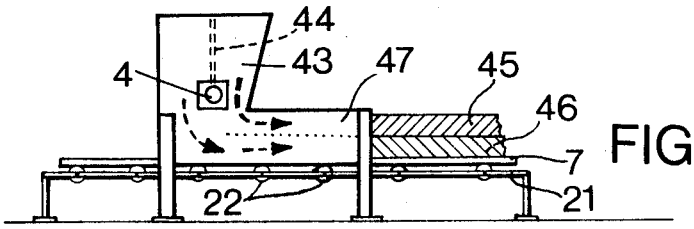

FIG. 11 shows one way of adapting the principle of the invention to the formation of a laminate of two different materials fed respectively into a hopper 43 on opposite sides of a partition 44. One or more vibrators 4 are used to fluidize the two materials which emerge as a laminate comprising layers 45, 46 from the extrusion chamber 47. By further division of the hopper 43 additional laminates may be formed. A base 7, similar to that of FIG. 3 is shown mounted on a roller bed 21, 22.

Figure 12:
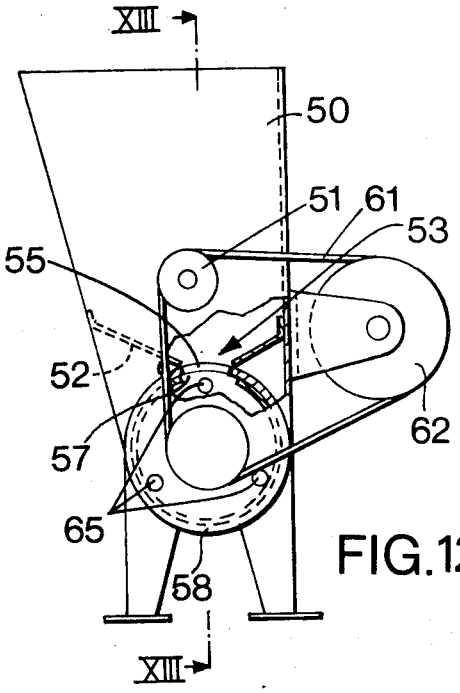
FIG. 12 is a side elevation of a machine for molding tubes.
Figure 13:
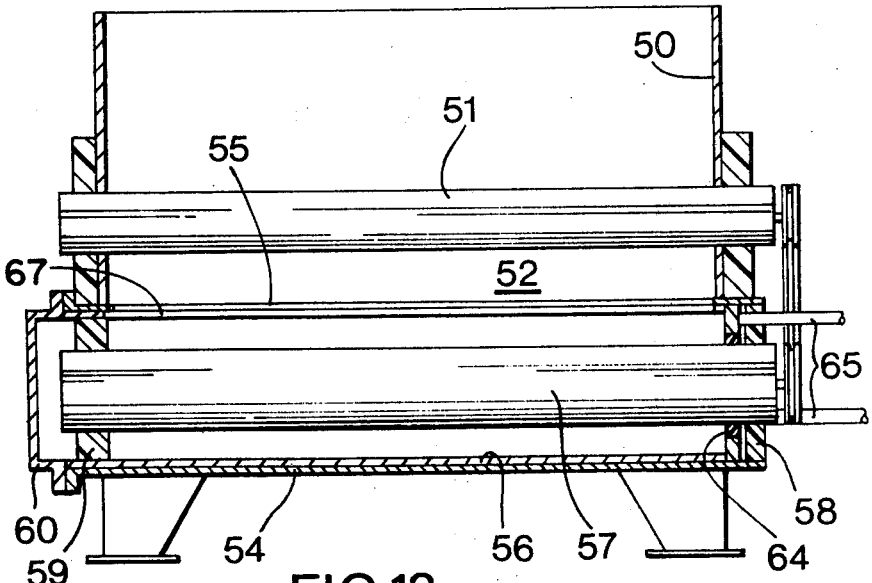
FIG. 13 is a vertical section on the line 13—13 in FIG. 12.
Figure 14:
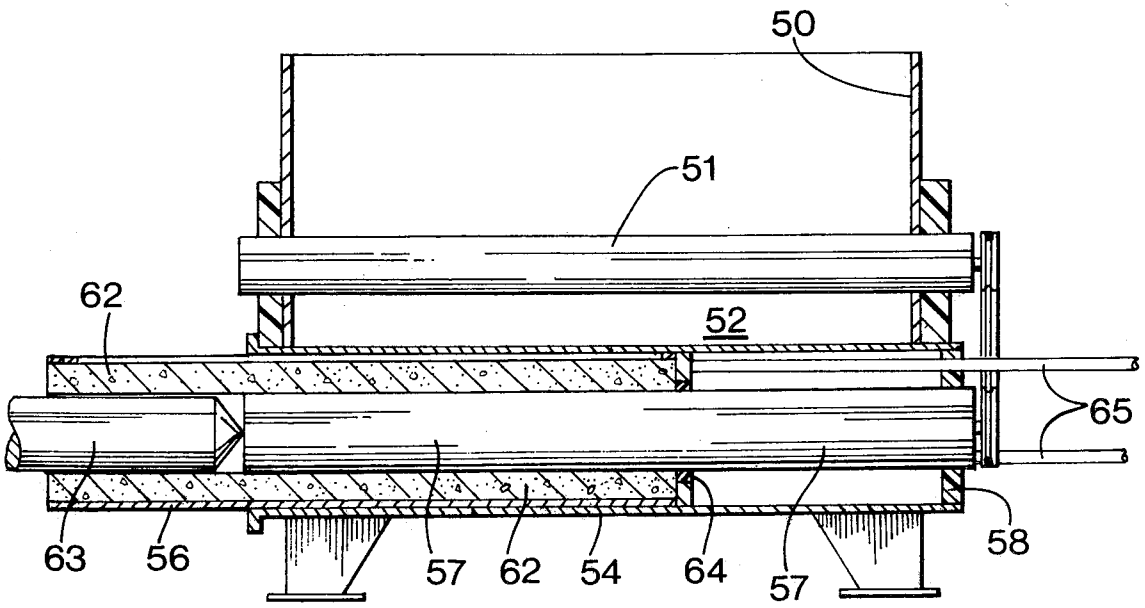
FIG. 14 is similar to FIG. 13 but shows some of the parts in different relative positions.

FIGS. 12 to 14 show an adaptation of the machine for molding tubes. In this adaptation a hopper 50 containing a vibrator 51 has a floor 52 formed with a longitudinal aperture 53 over a longitudinal slot 55 in a mold carrier 54 containing a tubular mold 56 which extends across the machine beneath the hopper 50. The mold 56 has a slot 67 therein which registers with the slot 55 in the mold carrier 54. The tube 62 (FIG. 14) is formed in the mold 56 around a vibrator 57 mounted co-axially in the mold carrier 54 in a rubber bush 58 fixed in one end of the mold carrier 54 and in a bush 59 mounted behind a removable cap 60 which closes the other end of the mold carrier 54, as shown in FIG. 13. The two vibrators 51 and 57 are connected by a belt 61 to a driving motor 62 shown in FIG. 12.

In operation, the vibrator 51 promotes the flow of material through the aperture 53 in the bottom of the hopper 50 and the slots 55, 67 in the mold carrier 54 and the mold 56. When the mold 56 has been filled, the vibrators 51, 57 are deactivated and the mold carrier 54 is rotated to cut off the supply of material by moving the slot 55 in the mold carrier 54 out of registration with the slot 53 in the bottom of the hopper 50. Then the cap 60 and the bush 59 are removed, a mandrel 63 is positioned in co-axial alignment with the vibrator 57 and an ejector mechanism comprising an annular thrust member 64 mounted on three rams 65 ejects the mold 56 with the tube 62 of molded material therein from the mold carrier 54 and the vibrator 57 onto the mandrel 63, as illustrated in FIG. 14.

Another method of molding tubes involves the use of a machine similar to that of FIG. 6, in which the material is extruded around longitudinal cores, of any practical crosssection, supported above the base 7. Each core may be located between a pair of longitudinal walls joined by a base. Thus, each tube may be molded around a core between the base 7, side walls and a top plate or through an extrusion mold. In another alternative, a machine similar to that of FIG. 5 or 6 may be adapted to the production of tubes transversely to the extrusion chamber, by arranging a removable mold carrier and mold in the hopper 31 concentric with the vibrator 4 therein.

Portland cement mixes containing alkali resistant glass fibers may be used in the various machines described above. A suitable portland cement composition designed for temperate conditions contains 5% by weight of alkali-resistant glass fibers having a chopped strand length between 12mm. and 50mm. inclusive, the portland cement water ratio being 0.25 to 0.35 by weight. For sustained aqueous conditions, 40% by weight of the portland cement may be replaced by pulverized fuel ash. For a high strength composition, alkali-resistant glass fiber up to 10% by weight may be added or the portland cement may be replaced by a high alumina cement. For some applications, up to 60% of the portland or high alumina cement may be replaced by a filler such as fine sand.

Another mix suitable for performing the invention comprises a mixture of glass fibers and an aqueous slurry of gypsum plaster. This mix may have a composition as described in British Pat. Specification No. 1,204,541 (National Research Development Corporation).

Figure 15:
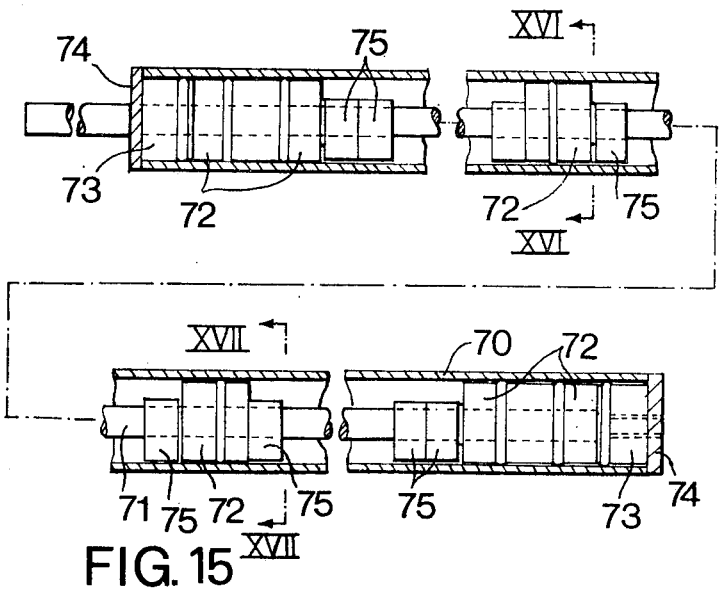
FIG. 15 is an axial section through a vibrator shown in any of the preceding FIGURES.
Figure 16:
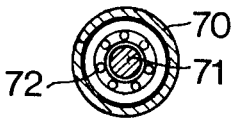
FIGS. 16 and 17 are respectively sections on the lines 16—16 and 17—17 in FIG. 15.
Figure 17:
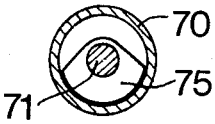

Each vibrator used in the aforesaid examples and indicated at 4 in FIGS. 1 to 11 and at 51 and 57 in FIGS. 12–14 is shown in FIGS. 15–17 and comprises a tube 70 through which passes a rotary shaft 71 mounted in bearings 72 distributed along the tube and arranged to be rotatably driven, for example, by the motor 5 and belt drive 6 of FIGS. 1 and 3. The ends of the tube are carried by resilient bushes 73 secured by end caps 74. Fixed to the shaft inside the tube are eccentric weights 75. As the shaft 71 is rotated, the eccentric weights will effect vibration of the shaft transversely of its axis and this vibration will be transmitted to the tube 70. Thus there will be a component of vibration in the direction of the intended flow through the hopper 1, 31, 40, 43 or 50, thereby to aid the flow of the material through the hopper. The mass and eccentricity of the weights 75 are chosen according to the use for which the vibrator is intended. Vibrator sizes varying from 30 cms. long and 2.5 cms. diameter to 270 cms. long and 10 cms. diameter have been tested and found suitable for the various cement and gypsum mixes specified above and for those mixes in common use in the construction industry. It is believed that smaller vibrators will be of use in industrial chemical production in specialized manufacturing processes where a powdered or granular material (wet or dry) is required to flow.

Frequency levels ranging from 3000 rpm to 11000 rpm and amplitudes from 1.6 mm. to 9.5 mm. have been tested with success. This range enables the machines to accept a very wide range of materials for processing and the nature of the material and water content are not critical factors. The fluidization produced by these vibrators maintains materials of the nature of cement or gypsum mixes in a fluid form until they have passed away from the influence of the vibrator. They set relatively rapidly after extrusion or molding particularly because of the compaction of the constituents and the elimination of occluded gas by the vibrators.

In the case of a mix such as those described above, which contain glass fibers, the amplitude and frequency of vibration decides the manner in which the fibers rest in the final material. Thus by controlling the vibrator or each vibrator, as by adjusting its speed or by substituting a vibrator having different qualities, it is possible to control, within limits, the properties of the material produced. For maximum strength in all directions the fibers should be orientated in random fashion, but by varying the vibration it is possible to make the fibers lie preponderantly in one plane, i.e. in the direction of extrusion from the hopper, and thus it is possible to increase the strength in that particular plane.

Accordingly, by turning the vibrator or vibrators about a vertical axis relatively to the mold or surface that receives the material, for example through 90°, it is possible to build up laminated material in which the fibers are orientated in different directions in adjacent layers. It can be seen that by combining a variety of adjustments it is possible to finely control the attitude of the fibers in the mix thus producing finished materials made up of regions wherein the directions of maximum strength are differently orientated.

It is also possible by adjusting the intensity of vibration, i.e. the power transmitted through the vibrators, to produce a more or a less dense material. If a high impact resistant material is required, a less dense material may be manufactured. If a material with a high limit of proportionality is required, a more dense material may be maufactured.

Figure 18:
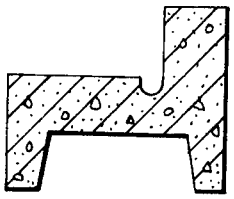
FIGS. 18 and 19 are cross-sections of components which can be extruded by the machines shown in the preceding Figures, with the exception of FIGS. 12 to 14.
Figure 19:
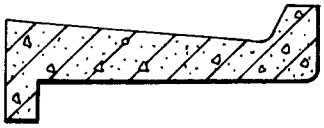

FIGS. 18 and 19 show extrusion sections which can be made from a material consisting of a 2:1 mix of ordinary portland cement and fine sand with a 0.3 water ratio and a 5% by weight addition of 25 mm. glass fibers. The fibers are orientated longitudinally. The following are results of tests carried out under 28 day conditions:

| MATRIX | Limit of Proportionality | Modulus of Rupture | Impact Strength | Density |
|---|---|---|---|---|
| OPC:2 Fine sand: 1 WR: 0.3 | $N/mm^2$ | $N/mm^2$ | $Nmm/mm^2$ | $t/m^3$ |
| across extrusion | 12.6 | 13.7 | 6.3 | 2.25 |
| along extrusion | 15.0 | 31.3 | 14.4 | |

Typical ratios of limit of proportionality to modulus of rupture are 48% along the direction of extrusion and 92% across the direction of extrusion.

I claim

1. Apparatus for extruding a material consisting of comminuted, powdered or other particulate solids, with or without added liquid, on a surface, said apparatus comprising a hopper open at the upper end thereof to receive said material and having a peripheral wall which at the lower end thereof encloses an area on said surface on which, in use, material from said hopper is deposited and retained within said peripheral wall; means defining a discharge aperture in said peripheral wall at the lower end of said hopper through which discharge aperture, in use, material enclosed by said peripheral wall is discharged from said hopper; an extrusion chamber integral with said hopper and extending laterally from the discharge aperture defining means and communicating with the discharge aperture, said extrusion chamber bounded by top and side walls and defining with said surface a tubular passage having an open delivery end remote from the discharge aperture and through which the material delivered by the hopper and through the extrusion chamber is to be extruded; means to enable relative movement to be effected between the extrusion chamber and the surface in the direction of the intended extrusion through the extrusion chamber and a mechanical vibrator within said hopper, the vibrator comprising a rotatable shaft resiliently mounted at its ends within the hopper at a position therein in which, during use of the apparatus, the shaft will be immersed in the material in the hopper; an eccentric weight on said shaft and means to rotate said shaft to effect vibration of said shaft and hence of the material in the hopper, the axis of rotation of said shaft extending transversely to the intended direction of flow to the discharge aperture of material in the hopper to effect said vibration in a direction to induce flow of material through the discharge aperture to the extrusion chamber.

2. Apparatus as claimed in claim 1 in which said surface is stationary and said hopper and said extrusion chamber are movable over said surface in a direction opposed to the direction of extrusion.

3. Apparatus as claimed in claim 1 in which there is a plurality of said vibrators in said hopper, said vibrators having shafts parallel to each other.

4. Apparatus as claimed in claim 1 in which there is a vibratable plate extending from the top wall of the extrusion chamber in the direction of extrusion and a vibrator arranged to effect vertical vibration of said plate.

5. Apparatus according to claim 1, in which the vibrator and said surface are arranged to undergo relative movement about a vertical axis whereby, when the material contains a dispersion of separate fibers, the preponderant direction of orientation of the fibers in the material is varied in relation to said surface.

6. Apparatus as claimed in claim 1 in which said surface is a fitted base extending between said side walls longitudinally through said extrusion chamber and forming with said top and side walls of the extrusion chamber said tubular passage.

7. Apparatus as claimed in claim 6 in which said hopper and said extrusion chamber are stationary and said fitted base is movable through said extrusion chamber in the direction of said extrusion.

8. Apparatus as claimed in claim 2 in which said material is arranged to be extruded as a continuous layer on said surface.

9. Apparatus according to claim 6, provided with means to adjust the vertical clearance between said hopper and said fitted base.

10. Apparatus according to claim 6, in which said extrusion chamber, includes an extrusion die transversely shaped according to a required configuration whereby material extruded from said hopper through said die is formed at all cross-sections along its length with the said configuration.

11. Apparatus according to claim 6, in which a guillotine blade is provided at the entrance to said extrusion chamber to cut off lengths of extruded material.

12. Apparatus according to claim 6, in which a transverse partition is provided in said hopper to enable two different materials to be fed into said hopper on opposite sides of said partition to produce an extruded laminate.

* * * * *